US010775736B1

(12) United States Patent
Moroka et al.

(10) Patent No.: US 10,775,736 B1
(45) Date of Patent: Sep. 15, 2020

(54) EXPOSURE APPARATUS AND IMAGE FORMING APPARATUS

(71) Applicant: FUJI XEROX CO., LTD., Tokyo (JP)

(72) Inventors: Junichi Moroka, Yokohama (JP); Satoshi Hashimoto, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 16/669,660

(22) Filed: Oct. 31, 2019

(30) Foreign Application Priority Data

Feb. 26, 2019 (JP) ..... 2019-032550

(51) Int. Cl.
*G03G 21/16* (2006.01)
*G03G 15/04* (2006.01)

(52) U.S. Cl.
CPC ..... *G03G 21/1666* (2013.01); *G03G 15/04* (2013.01); *G03G 15/04036* (2013.01); *G03G 15/04045* (2013.01); *G03G 15/04054* (2013.01); *G03G 2215/0402* (2013.01); *G03G 2215/0407* (2013.01); *G03G 2215/0409* (2013.01)

(58) Field of Classification Search
CPC ..... G03G 15/04; G03G 15/04036; G03G 15/04045; G03G 15/04054; G03G 21/1666; G03G 2215/0402; G03G 2215/0407; G03G 2215/0409
See application file for complete search history.

(56) References Cited

U.S. PATENT DOCUMENTS 4,703,334 A * 10/1987 Mochimaru ..... B41J 2/45 347/130
2005/0001896 A1* 1/2005 Wakisaka ..... G02B 3/0075 347/241
2016/0085208 A1* 3/2016 Imai ..... G03G 15/04054 347/118
2017/0219952 A1* 8/2017 Furuta ..... H01L 33/38
2018/0004117 A1* 1/2018 Kasuya ..... G03G 21/1619
2018/0004118 A1* 1/2018 Kasuya ..... G03G 15/04036
2018/0004119 A1* 1/2018 Kasuya ..... G03G 15/04036
2019/0072873 A1* 3/2019 No ..... G03G 15/0105

FOREIGN PATENT DOCUMENTS

JP 2009014984 A * 1/2009
JP 2018-001570 1/2018

OTHER PUBLICATIONS

English language machine translation of JP 2018-001570.

* cited by examiner

*Primary Examiner* — Ryan D Walsh
(74) *Attorney, Agent, or Firm* — Fildes & Outland, P.C.

(57) ABSTRACT

An exposure apparatus includes: a substrate that extends in a longitudinal direction intersecting with a gravity direction and has light emitting elements emitting light toward a gravity direction; a housing that extends in the longitudinal direction, to which the substrate is attached; a support section that supports both end side portions of the housing in the longitudinal direction against gravity; and a structure section having a weight that is attached to an intermediate portion of the housing in the longitudinal direction and supported by the support section in the gravity direction.

18 Claims, 10 Drawing Sheets

RELATED ART

EXPOSURE APPARATUS AND IMAGE FORMING APPARATUS

CROSS-REFERENCE TO RELATED APPLICATIONS

This application is based on and claims priority under 35 USC 119 from Japanese Patent Application No. 2019-032550 filed on Feb. 26, 2019.

BACKGROUND

Technical Field

The present invention relates to an exposure apparatus and an image forming apparatus.

Related Art

An exposure apparatus disclosed in Patent Document 1 includes a plate-shaped main body extending in one direction; a substrate having a plurality of light emitting elements mounted on one surface of the main body; a housing extending in one direction and having a frame shape where a through hole penetrating in a plate thickness direction of the main body is formed, the through hole in which the substrate is fixed; and a U-shaped member having a U shape opened to a side of the other surface of the main body in a cross section intersecting with the one direction, the U-shaped member fitting into the through hole.

CITATION LIST

Patent Literature

Patent Literature 1: JP-A-2018-1570

SUMMARY

When an image forming apparatus operates, a main body of the apparatus vibrates and the housing of the exposure apparatus provided in the image forming apparatus may also vibrate.

In the related art, in order to reduce vibration of the housing, a structure section having a weight is attached to the housing. The housing is a long member, and both end portions in a longitudinal direction of the housing are supported by a support section provided in the exposure apparatus. The longitudinal direction intersects with an exposure direction of the exposure apparatus. The structure section is attached to an intermediate portion of the housing in the longitudinal direction, and is supported only by the housing.

Since the structure section is supported only by the housing, when an exposure direction of the exposure apparatus with respect to an image holder is parallel to the gravity direction, the housing may bend in a gravity direction that is parallel to the exposure direction, due to gravity acting on the structure section.

Aspects of non-limiting embodiments of the present disclosure relate to reduce bending of the housing in the gravity direction in a configuration including a member that reduces vibration of the housing, as compared with a case where the structure section is supported only by the housing in the gravity direction.

Aspects of certain non-limiting embodiments of the present disclosure address the above disadvantages and/or other disadvantages not described above. However, aspects of the non-limiting embodiments are not required to address the disadvantages described above, and aspects of the non-limiting embodiments of the present disclosure may not address any of the disadvantages described above.

According to an aspect of the present disclosure, there is provided an exposure apparatus including:

a substrate that extends in a longitudinal direction intersecting with a gravity direction and has a plurality of light emitting elements emitting light toward a gravity direction;

a housing that extends in the longitudinal direction, to which the substrate is attached;

a support section that supports both end side portions of the housing in the longitudinal direction against gravity; and a structure section having a weight that is attached to an intermediate portion of the housing in the longitudinal direction and supported by the support section in the gravity direction.

BRIEF DESCRIPTION OF DRAWINGS

Exemplary embodiment(s) of the present invention will be described in detail based on the following figures, wherein.

DETAILED DESCRIPTION

Figure 1:
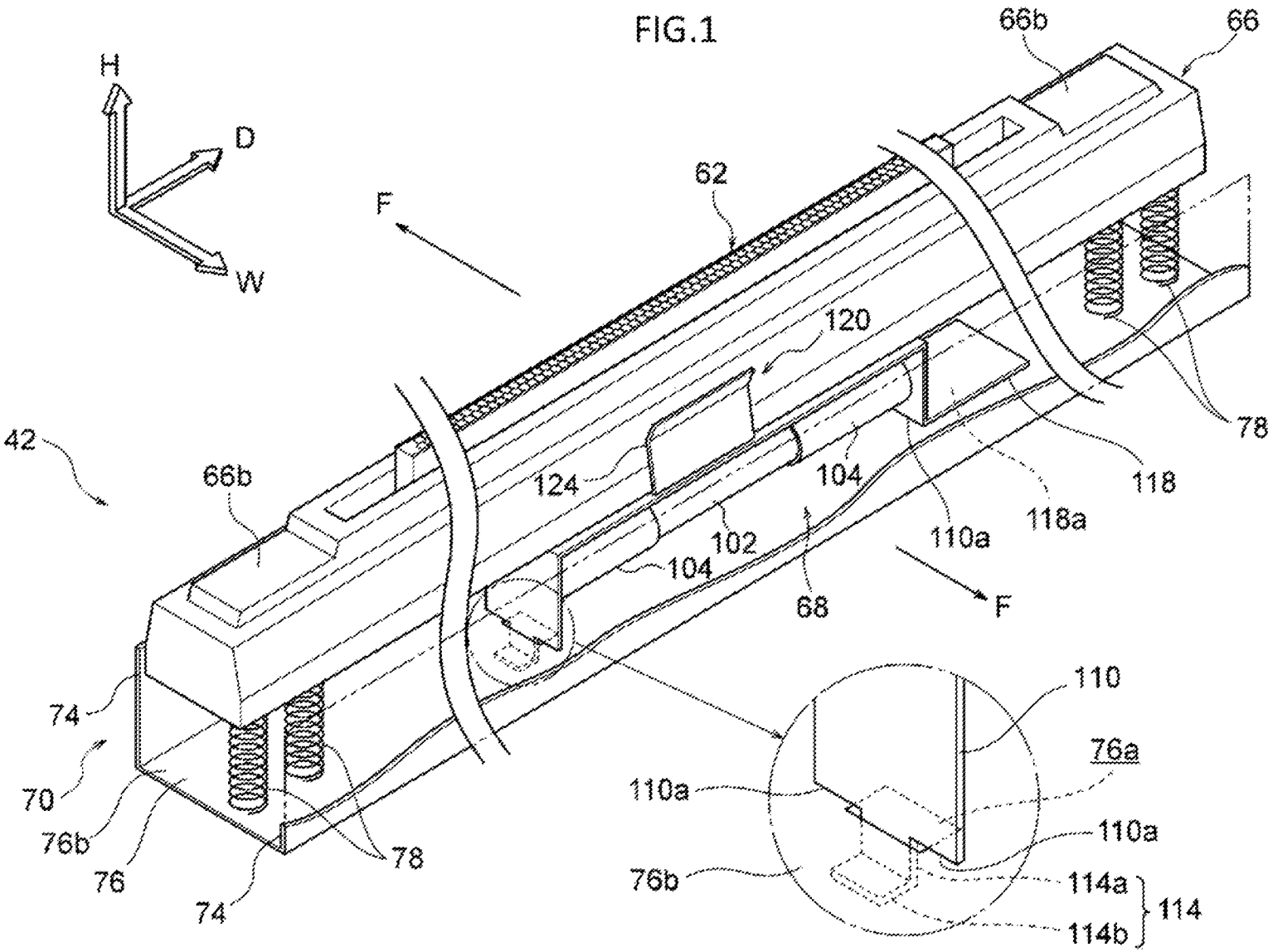
FIG. 1 is a perspective view showing an exposure apparatus according to an exemplary embodiment of the invention.

An exposure apparatus and an image forming apparatus according to an exemplary embodiment of the invention will be described with reference to FIGS. 1 to 9. An arrow H shown in the drawings indicates an apparatus vertical direction that is parallel to the gravity direction, an arrow W indicates an apparatus width direction that is one horizontal direction, and an arrow D indicates an apparatus length direction that is another horizontal direction.

(Overall Configuration)

Figure 8:
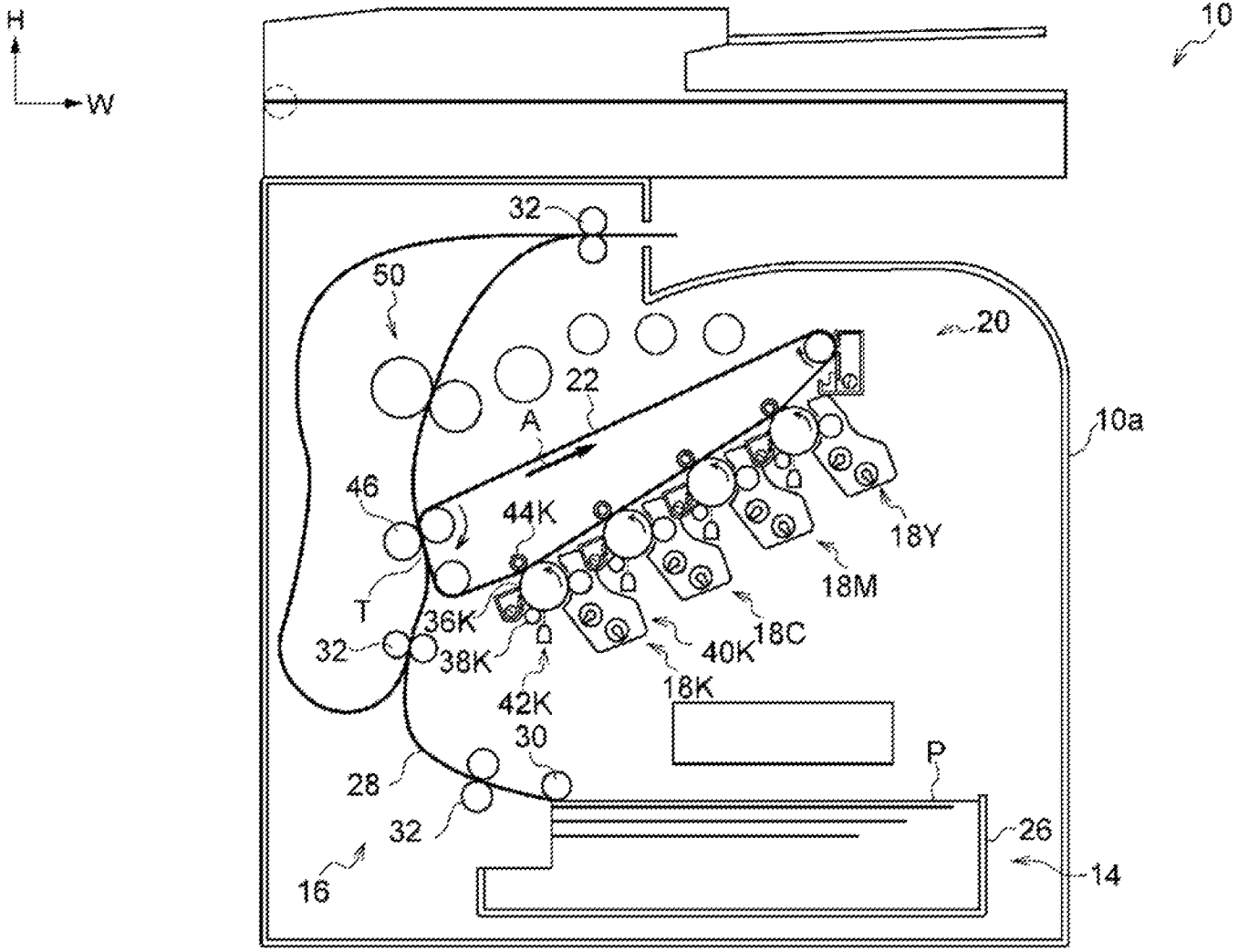
FIG. 8 is a schematic configuration diagram showing an image forming apparatus according to an exemplary embodiment of the invention.

As shown in FIG. 8, an image forming apparatus 10 according to the exemplary embodiment includes a container 14 that faces upward from a lower side in the vertical direction (a direction of the arrow H) and accommodates a sheet member P as a recording medium, a conveyer 16 that conveys the sheet member P accommodated in the container 14, and an image forming section 20 that forms an image on the sheet member P conveyed by the conveyer 16 from the container 14 in this order.

[Container]

The container 14 includes a drawer 26 that can be drawn out from an apparatus main body 10*a* of the image forming apparatus 10 to a front side in the apparatus length direction, and the sheet member P is loaded on the drawer 26. The drawer 26 includes a delivery roller 30 that delivers the sheet member P stacked on the drawer 26 to a conveyance path 28 constituting the conveyer 16.

[Conveyer]

The conveyer 16 includes a plurality of conveyer rollers 32 that convey the sheet member P along the conveyance path 28 in which the sheet member P delivered from the container 14 is conveyed.

[Image Forming Section]

The image forming section 20 includes four image forming units 18Y, 18M, 18C, and 18K of yellow (Y), magenta (M), cyan (C), and black (K). In the following description, Y, M, C, and K may be omitted when Y, M, C, and K need not to be distinguished and described.

Each of the image forming units 18 of each color can be attached to and detached from the apparatus main body 10*a*. Each of the image forming units 18 of each color includes an image holder 36, a charging member 38 that charges a surface of the image holder 36, and an exposure apparatus 42 that irradiates the image holder 36 with exposure light. Each of the image forming units 18 of each color includes a development device 40 that develops an electrostatic latent image on the charged image holder 36 and visualizes as a toner image, the electrostatic latent image being formed by the exposure apparatus 42 irradiating the charged image holder 36 with the exposure light. A configuration of the exposure apparatus 42 will be described in detail later.

The image forming section 20 includes an endless transfer belt 22 that circulates in a direction of an arrow A in FIG. 8, and primary transfer rollers 44 that transfers the toner image formed by the image forming units 18 of each color to the transfer belt 22. The image forming section 20 includes a secondary transfer roller 46 that transfers the toner image transferred to the transfer belt 22 to the sheet member P carried on the conveyance path 28, and a fixing unit 50 that heats and pressurizes the sheet member P to which the toner image is transferred and fixes the toner image to the sheet member P.

(Operation of Image Forming Apparatus)

In the image forming apparatus 10, an image is formed as follows.

First, the charging member 38 of each color to which a voltage is applied uniformly negatively charges a surface of the image holder 36 of each color at a predetermined potential. Subsequently, based on image data received from the outside, the exposure apparatus 42 irradiates the surface of the charged image holder 36 of each color with exposure light to form the electrostatic latent image.

Accordingly, the electrostatic latent image corresponding to the data is formed on the surface of the image holder 36 of each color. The development device 40 of each color develops the electrostatic latent image and visualizes the image as a toner image. The toner image formed on the surface of the image holder 36 of each color is transferred to the transfer belt 22 by the primary transfer roller 44.

Then, the sheet member P delivered from the drawer 26 to the conveyance path 28 by the delivery roller 30 is delivered to a transfer position T where the transfer belt 22 contacts with a secondary transfer roller 46. At the transfer position T where the sheet member P is conveyed between the transfer belt 22 and the secondary transfer roller 46, the toner image on the surface of the transfer belt 22 is transferred to the surface of the sheet member P.

The toner image transferred to the surface of the sheet member P is fixed on the sheet member P by the fixing unit 50. The sheet member P on which the toner image is fixed is discharged to the outside of the apparatus main body 10*a*.

(Main Part Configuration)

Next, the exposure apparatus 42 and the like will be described.

Figure 5:
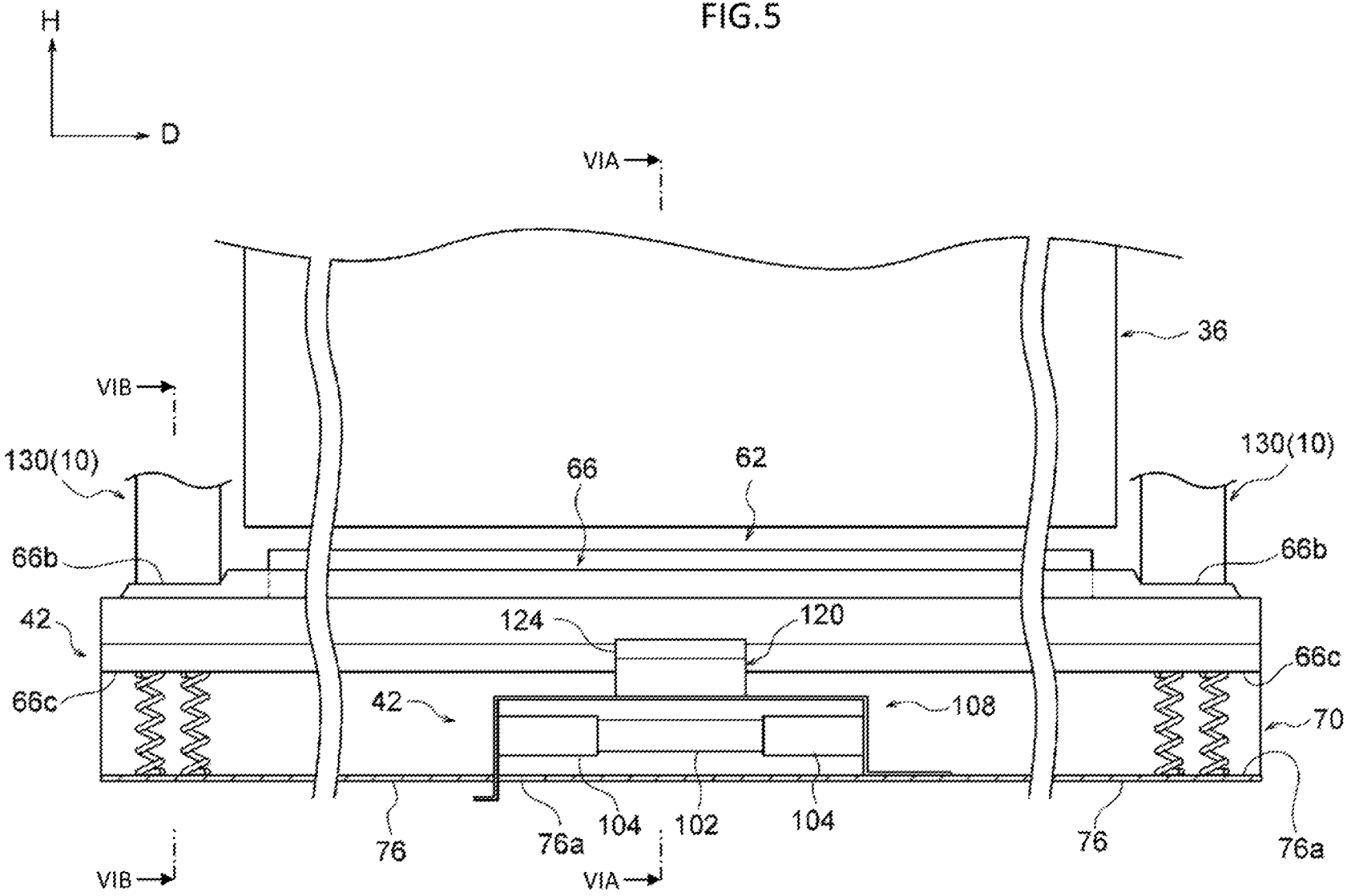
FIG. 5 is a side view showing the exposure apparatus according to an exemplary embodiment of the invention.

The exposure apparatus 42 is an LED printhead, and is disposed below the image holder 36 as shown in FIG. 5.

Figure 2:
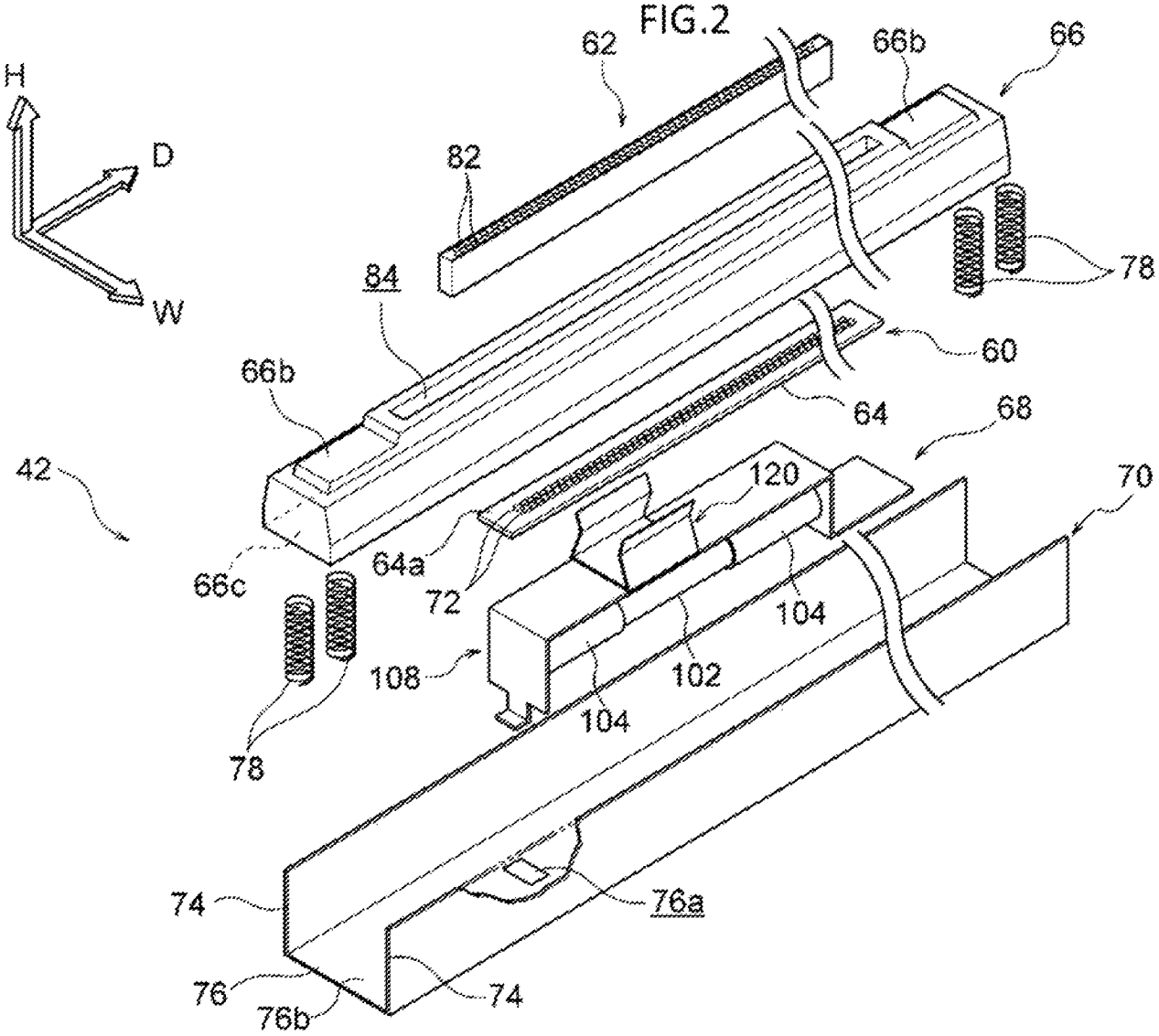
FIG. 2 is an exploded perspective view showing the exposure apparatus according to an exemplary embodiment of the invention.

As shown in FIG. 1 and FIG. 2, the exposure apparatus 42 includes a substrate 60 extending in the apparatus length direction (a longitudinal direction), a surface of which faces the vertical direction, and a lens array 62 disposed above the substrate 60 and extending in the apparatus length direction. The exposure apparatus 42 includes a housing 66 to which the substrate 60 and the lens array 62 are attached, and a vibration suppressor 68 attached to the housing 66. The exposure apparatus 42 includes a support member 70 that supports the housing 66 and the vibration suppressor 68, and a compression coil spring 78 (hereinafter, "spring 78"). The vibration suppressor 68 is an example of the structure section.

[Substrate]

As shown in FIG. 2, the substrate 60 includes a plate-shaped main body 64 and a plurality of light emitting elements 72 mounted on an upper surface 64*a* of the main body 64. The main body 64 is a print wiring substrate, surfaces of which face the vertical directions, and has a rectangular shape extending in the apparatus length direction when viewed from above. The light emitting elements 72 are light emitting diodes (LEDs), and are disposed in a zigzag form in which two arrays of the light emitting elements 72 alternate in the apparatus length direction (D) on the upper surface 64*a* of the main body 64, the arrays extending in the apparatus length direction. The plurality of light emitting elements 72 emit light in the vertical direction (gravity direction).

[Lens Array]

As shown in FIG. 2, the lens array 62 has a rectangular parallelepiped shape extending in the apparatus length direction. The cross-sectional shape of the lens array 62 orthogonal to the apparatus length direction is a rectangular shape extending in the apparatus vertical direction (see FIG. 6A). In the lens array 62, a plurality of rod lenses 82 are disposed in the zigzag form in which two arrays of the rod lenses 82 alternate in the apparatus length direction, the arrays extending in the apparatus length direction. Each of the rod lenses 82 extends in the vertical direction and transmits light emitted from each of the light emitting elements 72 to form an image on the image holder 36 (see FIG. 5).

In this way, an exposure direction of the exposure apparatus 42 to the image holder 36 is parallel to the vertical direction (gravity direction).

[Housing]

The housing 66 is formed of a liquid crystal polymer, which is a resin material, and extends in the apparatus length direction as shown in FIG. 2. A through hole 84 that penetrates the housing 66 in the apparatus vertical direction and extends in the apparatus length direction is formed. As described above, the housing 66 has a frame shape.

Figure 6A:
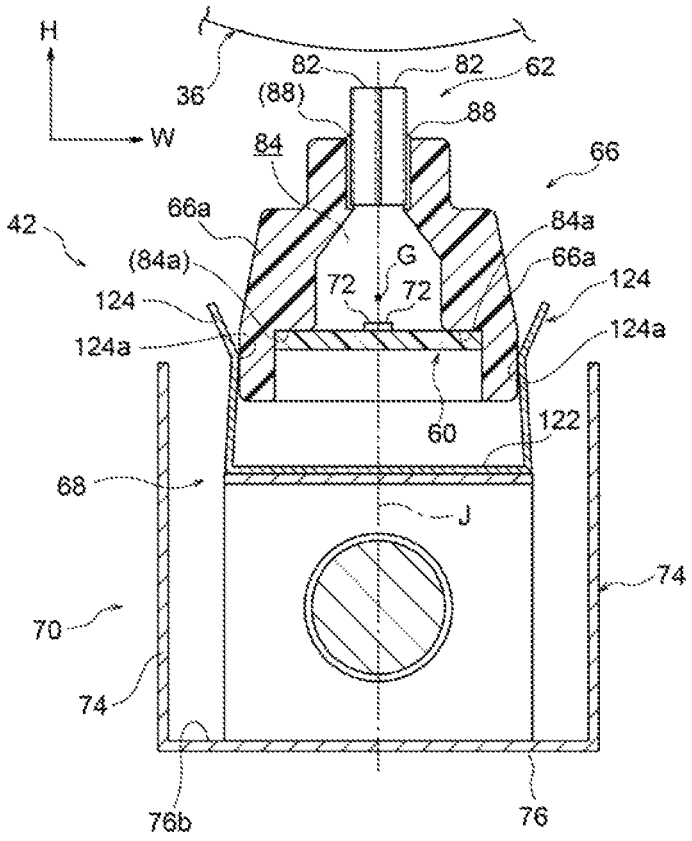
FIG. 6A and FIG. 6B are sectional views showing the exposure apparatus according to an exemplary embodiment of the invention.
Figure 6B:
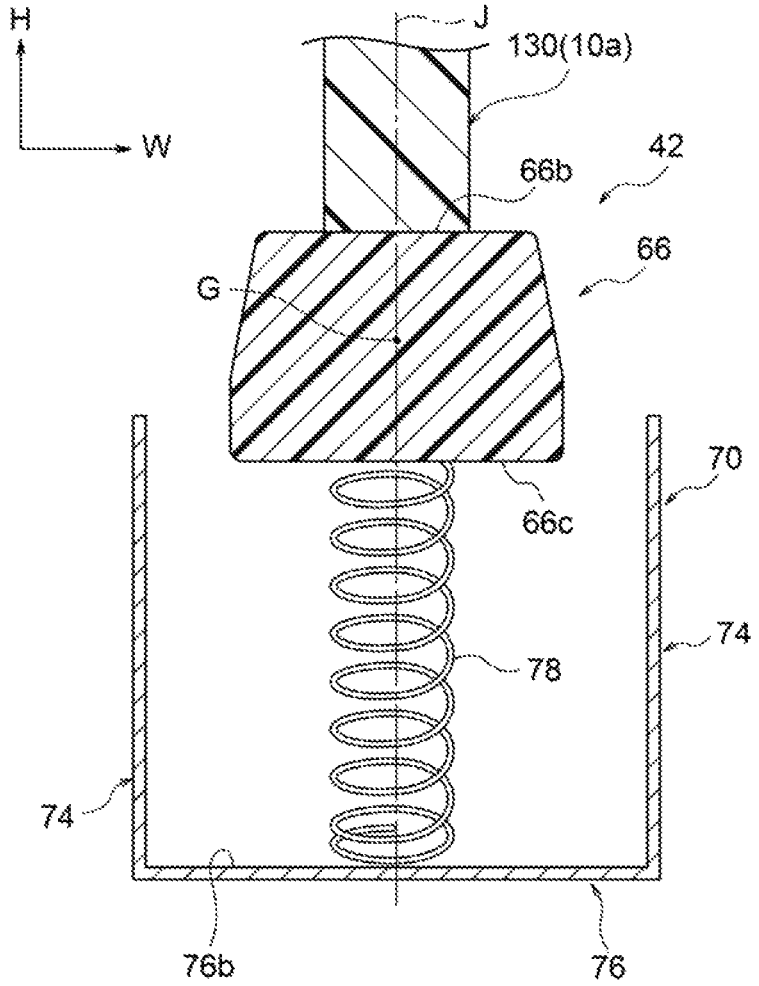

FIG. 6A is a cross-section taken along the line VIA-VIA in FIG. 5, and FIG. 6B is a cross-section taken along the line VIB-VIB in FIG. 5. As shown in FIGS. 6A and 6B, a shape of the housing 66 in a cross section orthogonal to the apparatus length direction is symmetrical with respect to a line J extending in the apparatus vertical direction through a center of gravity G in the cross section of the housing 66. In a portion where the through hole 84 is formed in the housing 66, as shown in FIG. 6A, a pair of wall portions 66*a* extending in the apparatus vertical direction are formed with the through hole 84 sandwiched therebetween.

The lens array 62 is fixed to an upper end portion of the through hole 84 formed in the housing 66 by an adhesive (UV curable adhesive) (not shown). A gap between the housing 66 and the lens array 62 is filled with a sealant 88 over an entire periphery of the lens array 62. This prevents dust or the like from penetrating into an interior of the housing 66 through a gap between the housing 66 and the lens array 62.

In the housing 66, a step portion 84*a* is formed over an entire circumference of the through hole 84 so as to widen an opening on a lower end portion of the through hole 84. An end portion of the substrate 60 is fixed on the step portion 84*a* using an adhesive (not shown) so that the light emitting elements 72 faces the lens array 62 in the vertical direction. This prevents dust or the like from penetrating into the interior of the housing 66 through a gap between the step portion 84*a* and the substrate 60.

As shown in FIGS. 2 and 6B, a planar upper surface portion 66*b* facing upward and a planar lower surface portion 66*c* facing downward are formed at both end portions in the apparatus length direction in which the through hole 84 is not formed in the housing 66. The apparatus main body 10*a* includes a pair of reference frames 130 that contact the upper surface portion 66*b* in the vertical direction.

[Support Member 70, Spring 781

The support member 70 is formed by bending a trimmed sheet metal, and extends in the apparatus length direction (D) as shown in FIG. 2. As shown in FIG. 6A, the support member 70 has a U-shape opening upward in the cross section orthogonal to the apparatus length direction (D). The support member 70 is an example of a support section.

As shown in FIG. 2 and FIG. 6A, the support member 70 includes a pair of side plates 74 whose surface faces the apparatus width direction (W), and a bottom plate 76 whose surface faces the vertical direction (H). The bottom plate 76 has a rectangular shape extending in the apparatus length direction (H) when viewed from above, and a rectangular through hole 76*a* extending in the apparatus width direction (W) is formed in an intermediate portion of the bottom plate 76 in the apparatus length direction (H). The support member 70 is supported from below by a frame member (not shown) provided on the apparatus main body 10*a*.

As shown in FIG. 2 and FIG. 6B, four springs 78 are disposed in a compressed state between the lower surface portion 66*c* of the housing 66 and an upper surface 76*b* of the bottom plate 76 of the support member 70. Specifically, two springs 78 are disposed at both end portions of the housing 66 respectively, and are arranged in the apparatus length direction (D).

In this configuration, the support member 70 supports portions on both end sides of the housing 66 in the vertical direction (gravity direction) via the springs 78. As shown in FIG. 5, the upper surface portions 66*b* of the housing 66 are pressed against the reference frames 130 by urging forces of the springs 78 so that a position of the housing 66 in the vertical direction is determined. Accordingly, a relative position between the support member 70 and the housing 66 in the vertical direction varies.

[Vibration Suppressor 68]

The vibration suppressor 68 is a dynamic vibration absorber or a dynamic damper. As shown in FIG. 1 and FIG. 2, the vibration suppressor 68 is attached to an intermediate portion of the housing 66 in the apparatus length direction (D) and supported by the support member 70 in the vertical direction (gravity direction). Here, the "intermediate portion of the housing 66 in the apparatus length direction" is a portion defined in a range of 30 to 70 from one end of the housing 66 when a length of the housing 66 in the apparatus length direction is 100.

That is, in the exemplary embodiment, when the length of the housing 66 in the apparatus length direction is 100, the vibration suppressor 68 is attached to a portion defined in a range of 30 to 70 from one end of the housing 66. Here, in view of reducing vibration occurred on the housing 66, it is better if the vibration suppressor 68 is attached to a mid-portion defined in a range of 40 to 60 from one end of the housing 66, and it is particularly good if the vibration suppressor 68 is attached to a central portion defined in a range of 45 to 55 from one end of the housing 66.

Figure 3:
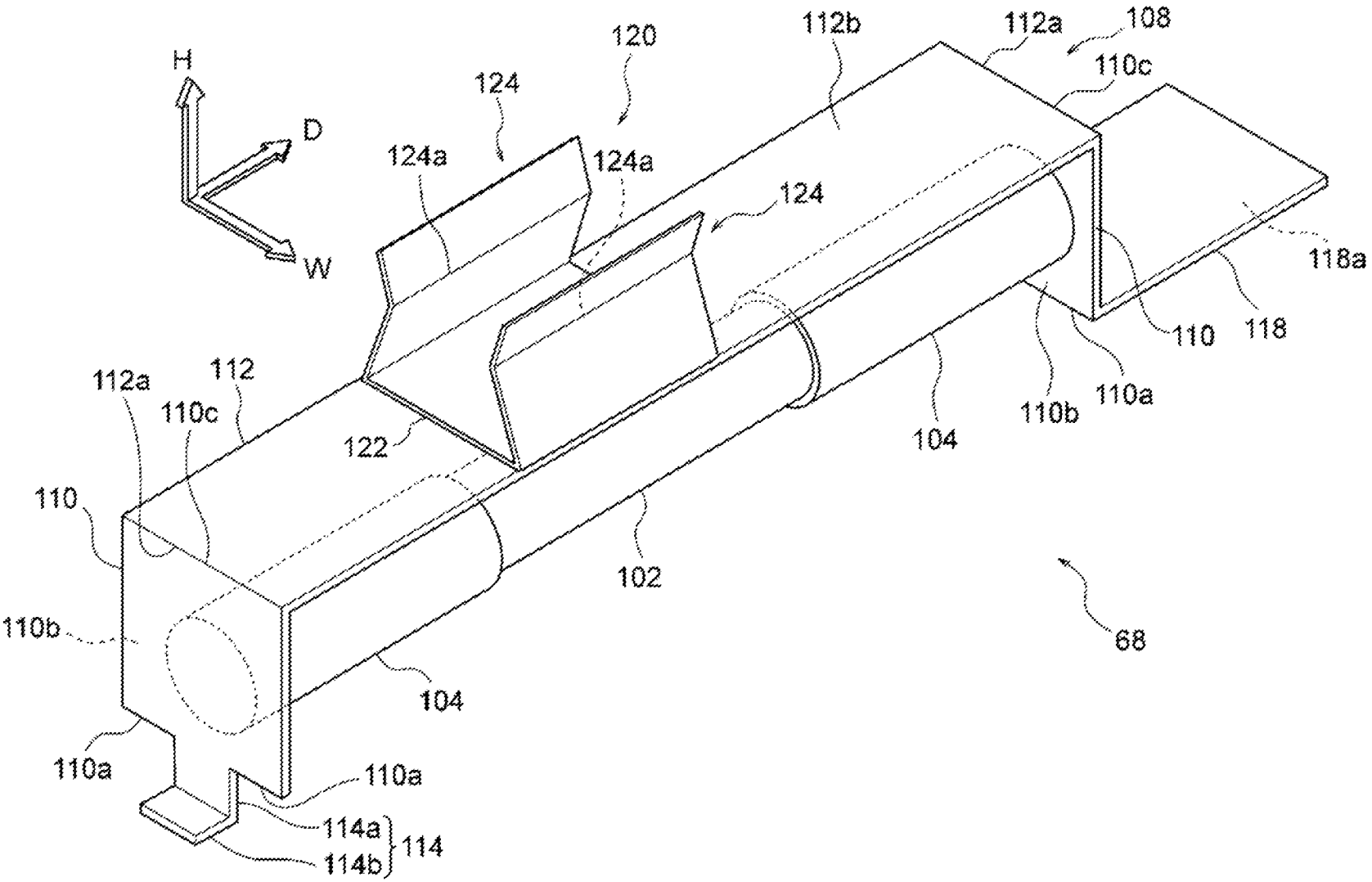
FIG. 3 is a perspective view showing a vibration suppressor provided in the exposure apparatus according to an exemplary embodiment of the invention.

As shown in FIG. 1, the vibration suppressor 68 extends in the apparatus length direction, and is disposed below the housing 66 and above the bottom plate 76 of the support member 70. As shown in FIG. 3, the vibration suppressor 68 includes a weight 102 extending in the apparatus length direction, and a pair of elastic portions 104 sandwiching the weight 102 in the apparatus length direction (D) and capable of elastically deforming in the apparatus width direction (W). The vibration suppressor 68 includes an attachment section 108 to which the weight 102 is attached via the elastic portion 104 and a holding portion 120 having a pair of sheet springs 124 that sandwich the housing 66 therebetween in the apparatus width direction (W).

—Weight 102, Elastic Portion 104—

The weight 102 is formed of a metal material and has a cylindrical shape extending in the apparatus length direction (D), as shown in FIG. 3. The pair of elastic portions 104 are formed of a rubber material and disposed so as to sandwich the weight 102 therebetween in the apparatus length direction (D). The elastic portions 104 have a cylindrical shape extending in the apparatus length direction (D), and the weight 102 is fixed to one ends of the elastic portions 104 by a fixing material (not shown).

—Attachment Section 108—

The attachment section 108 is formed by bending a trimmed sheet metal, and extends in the apparatus length direction as shown in FIG. 3. The attachment section 108 includes: a pair of clamping plates 110 disposed so that the plate surface faces the apparatus length direction (D) and the weight 102 and the pair of elastic portions 104 are sandwiched therebetween in the apparatus length direction; and a coupling plate 112 that couples the pair of clamping plates 110, a surface of which facing the vertical direction. The attachment section 108 includes an L-shaped plate 114 connected to one clamping plate 110 and a flat plate 118 connected to the other clamping plate 110.

The pair of clamping plates 110 are separated in the apparatus length direction, and as described above, sandwich the weight 102 and the pair of elastic portions 104 in the apparatus length direction (D). The pair of clamping plates 110 has a rectangular shape having a pair of edges extending in the vertical direction (H) and a pair of edges extending in the apparatus width direction (W) when viewed from the apparatus length direction (D). A lower end edge

110*a* of the clamping plate 110 is configured to contact with the upper surface 76*b* of the bottom plate 76 of the support member 70 (see FIG. 1).

When viewed from the apparatus length direction (D), the weight 102 and the pair of elastic portions 104 are disposed in a region of the clamping plate 110. The surfaces 110*b* of the clamping plates 110 fix the other ends of the elastic portions 104 with a fixing material (not shown) respectively, the surfaces 110*b* facing to the other ends of the elastic portions 104.

The coupling plate 112 is disposed above the weight 102 and the pair of elastic portions 104, and has a rectangular shape extending in the apparatus length direction (D) when viewed from the vertical direction (H). Both end edges 112*a* of the coupling plate 112 in the apparatus length direction are connected with upper end edges 110*c* of the pair of clamping plates 110 respectively.

Figure 4:
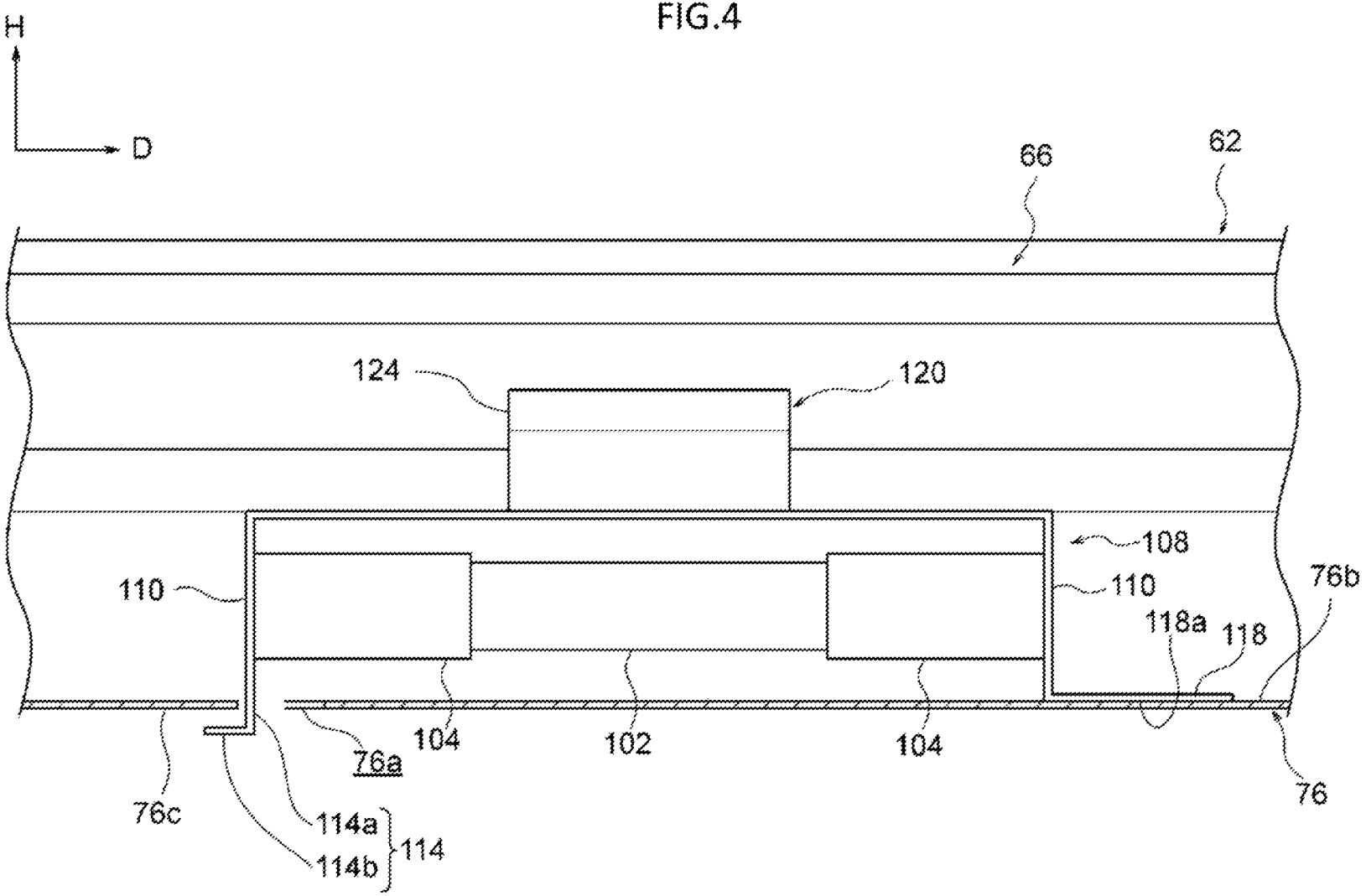
FIG. 4 is an enlarged side view showing the exposure apparatus according to an exemplary embodiment of the invention.

The flat plate 118 is connected to the lower end edge 110*a* of the clamping plate 110 on a back side (right side in FIG. 4) in the apparatus length direction (D), and the plate surface faces the vertical direction (H). The flat plate 118 extends from the lower end edge 110*a* of the clamping plate 110 on the back side toward the back side in the apparatus length direction (D). A lower surface 118*a* of the flat plate 118 is configured to contact with the upper surface 76*b* of the bottom plate 76 of the support member 70, as shown in FIG. 4.

As shown in FIG. 3, an L-shaped plate 114 is connected to the lower end edge 110*a* of the clamping plate 110 on a front side (left side in FIG. 4) in the apparatus length direction (D). Specifically, the L-shaped plate 114 extends downward from a center portion of the lower end edge 110*a* of the clamping plate 110 on the front side in the apparatus length direction (D), and has a base portion 114*a* whose surface faces the apparatus length direction (D) and a tip portion 114*b* extending from the lower end edge of the base portion 114*a* to the front side in the apparatus length direction (D), of which a surface faces the vertical direction (H).

A length of the L-shaped plate 114 in the apparatus width direction (W) is shorter than a length in the apparatus width direction (W) of the through hole 76*a* (see FIG. 1) of the bottom plate 76 of the support member 70. As shown in FIG. 1 and FIG. 4, a part of the L-shaped plate 114 protrudes to a lower region of the bottom plate 76 from the through hole 76*a* of the bottom plate 76. A part of the tip portion 114*b* of the L-shaped plate 114 faces a lower surface 76*c* facing the lower region of the bottom plate 76 in the vertical direction (H).

In this configuration, when the vibration suppressor 68 rises upward with respect to the support member 70, the tip portion 114*b* of the L-shaped plate 114 comes into contact with the bottom plate 76. This prevents the vibration suppressor 68 from dropping out of (moving from) the support member 70. In this way, the L-shaped plate 114 functions as a locking unit that prevents the vibration suppressor 68 from dropping out of the support member 70.

As described above, the lower surface 118*a* of the attachment section 108 faces to and contacts with the upper surface 76*b* of the bottom plate 76 of the support member 70. A length of the L-shaped plate 114 in the apparatus width direction (W) is shorter than the length of the through hole 76*a* of the bottom plate 76 of the support member 70 in the apparatus width direction (W). Therefore, the vibration suppressor 68 is movable with respect to the support member 70 in the apparatus width direction (W) in a predetermined range. The apparatus width direction (W) is one of intersection directions intersecting with the gravity direction.

—Holding Portion 120—

As shown in FIG. 3, the holding portion 120 is formed of a trimmed spring steel sheet, and is disposed on the coupling plate 112 of the attachment section 108 in an intermediate region of the coupling plate 112 in the apparatus length direction.

The holding portion 120 has a U shape opening upward when viewed from the apparatus length direction (D), and includes a bottom plate 122 that contacts the coupling plate 112, and a pair of sheet springs 124 erected from both end edges of the bottom plate 122 in the apparatus width direction (W) and sandwiching the housing 66 therebetween (see FIG. 6A) in the apparatus width direction (W).

The bottom plate 122 has a rectangular shape extending in the apparatus length direction (D) when viewed from above. Surfaces of the bottom plate 122 face the vertical direction (H). A pair of edges of the bottom plate 122 in the apparatus width direction (W) extending in the apparatus length direction (D) overlap with a pair of edges of the coupling plate 112 extending in the apparatus length direction (D) when viewed from above. The bottom plate 122 is fixed to an upper surface 112*b* of the coupling plate 112 using a fixing material (not shown).

The pair of sheet springs 124 are erected from both end edges in the apparatus width direction (W) of the bottom plate 122. The sheet springs 124 are separated with each other in the apparatus width direction (W). The sheet springs 124 have rectangular shapes extending in the apparatus length direction (D) when viewed from the apparatus width direction (W). The sheet springs 124 are bent, and as shown in FIG. 6A, ridges 124*a* are formed on the sheet springs 124 when viewed from the apparatus length direction (D). Each ridge 124*a* protrudes toward the other sheet spring 124 facing each other.

The protruding portion 124*a* formed on each sheet spring 124 is in contact with the wall portion 66*a* of the housing 66, and each sheet spring 124 elastically bends, so that the pair of sheet springs 124 sandwich the intermediate portion of the housing 66 in the apparatus length direction in the apparatus width direction. In other words, a distance between the pair of protruding portions 124*a* not sandwiching the housing 66 is smaller than a thickness of the housing 66 in the apparatus width direction. In this way, the vitration suppressor 68 is attached to the intermediate portion of the housing 66.

Here, the bottom plate 122 of the holding portion 120 and the housing 66 are separated in the vertical direction. A vertical position of the housing 66 is determined by a position of the reference frame 130, and a vertical position of the vibration suppressor 68 is determined by a position of the bottom plate 76 of the support member 70. Therefore, the vertical position of the housing 66 and the vertical position of the vibration suppressor 68 vary independently. Therefore, by adjusting the position of the housing 66 sandwiched by the pair of sheet springs 124, relative variation between the housing 66 and the vibration suppressor 68 is absorbed. In this way, the vibration suppressor 68 is attached to the housing 66 so that the position of the vibration suppressor 68 in the gravity direction with respect to the housing 66 can be adjusted. Since a space is formed between the bottom plate 122 and the housing 66, the support member 70 functions as an absorber that absorbs the relative variation between the housing 66 and the vibration suppressor 68.

The vibration suppressor 68 is attached to the housing 66 by the pair of sheet springs 124 sandwiching the housing 66 in the apparatus width direction (W). Accordingly, the vibration suppressor 68 moves in the apparatus width direction (W) with respect to the support member 70 so that bending amounts of the sheet springs 124 with respect to the housing 66 are the same. The center of gravity of the vibration suppressor 68 and the center of gravity of the housing 66 are in the same position in the apparatus width direction (W). That is, the pair of sheet springs 124 function as position adjusting sections that adjust the position of the vibration suppressor 68 in the apparatus width direction (W) to the position of the housing 66 in the apparatus width direction (W).

Figure 7A:
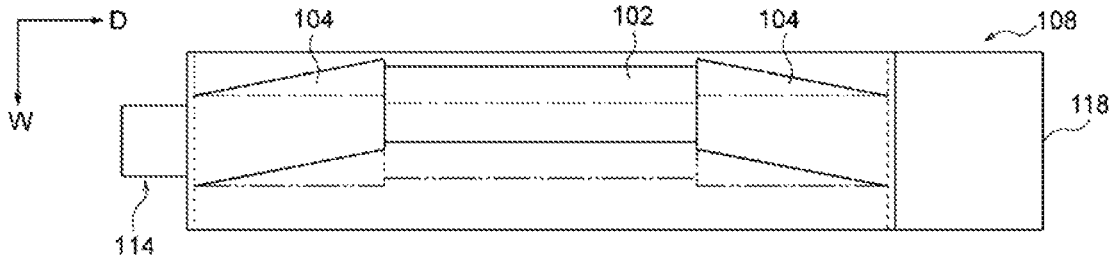
FIG. 7A, FIG. 7B, and FIG. 7C are operation diagrams showing movement of a weight provided in the exposure apparatus according to an exemplary embodiment of the invention.
Figure 7B:
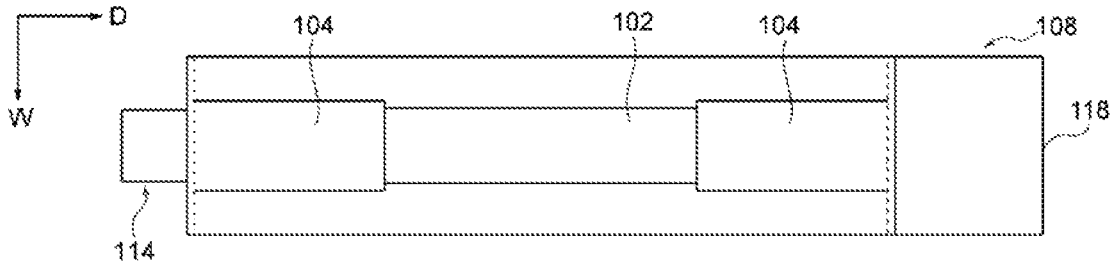
Figure 7C:
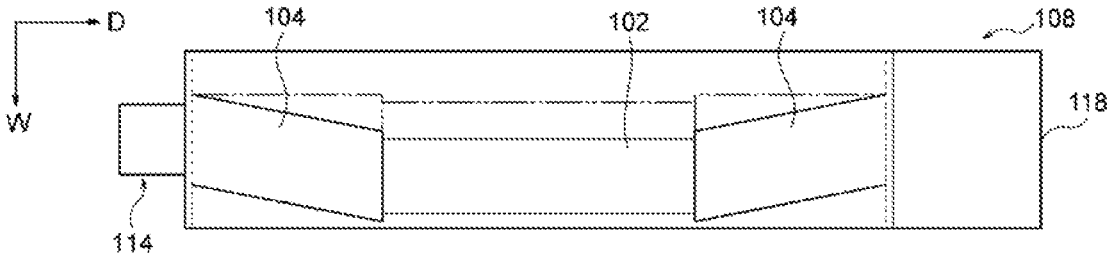

FIGS. 7A, 7B, and 7C are plan views of the vibration suppressor 68. In this configuration, when vibration in the apparatus width direction (W) is transmitted to the housing 66 along with image forming operation of the image forming apparatus 10, as shown in FIGS. 7A, 7B, and 7C, the weight 102 vibrates in the apparatus width direction while the elastic portion 104 of the vibration suppressor 68 is deformed. Accordingly, the vibration of the housing 66 is reduced.

(Operation of Main Part Configuration)

Next, operation of the main part configuration will be described in comparison with the exposure apparatus 542 according to a comparative embodiment. First, concerning a configuration of the exposure apparatus 542, portions different from the exposure apparatus 42 will be mainly described.

[Configuration of Exposure Apparatus 542]

Figure 9:
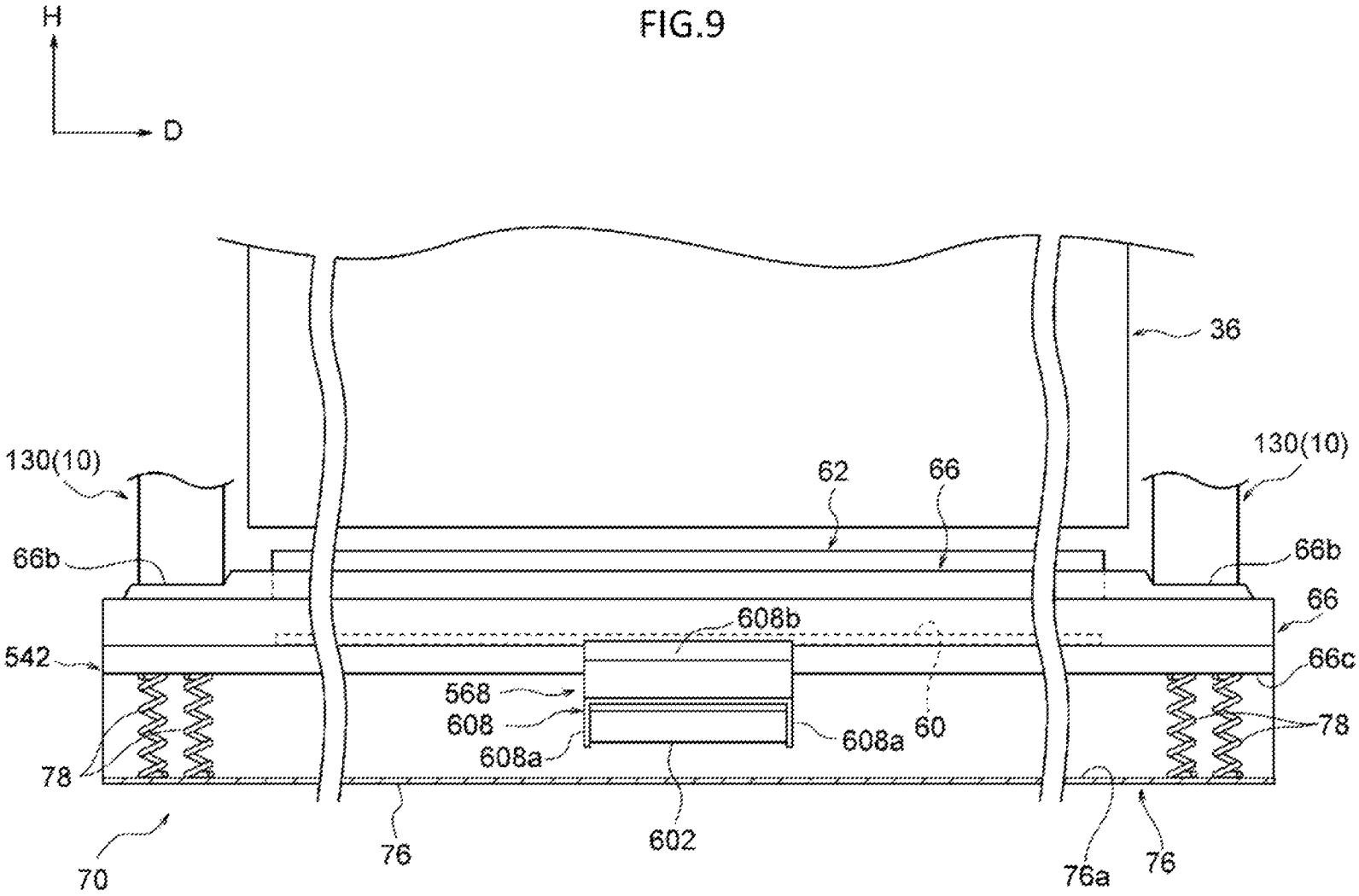
FIG. 9 is a side view showing an exposure apparatus according to a comparative embodiment of the exemplary embodiment of the invention.

As shown in FIG. 9, the exposure apparatus 542 includes the substrate 60, the lens array 62, the housing 66, the support member 70, and the spring 78. The exposure apparatus 542 includes a vibration suppressor 568 attached to the housing 66.

The vibration suppressor 568 is a mass damper and is attached to an intermediate portion of the housing 66 in the apparatus length direction (D), and is separated from the bottom plate 76 of the support member 70 in the vertical direction. (H) In other words, the vibration suppressor 568 is supported only by the housing 66 in the gravity direction.

The vibration suppressor 568 includes a cylindrical weight 602 extending in the apparatus length direction, and an attachment section 608 to which the weight 602 is attached. The attachment section 608 includes clamping portions 608*a* that sandwich the weight 602 in the apparatus length direction, and clamping portions 608*b* that sandwich the housing 66 in the apparatus width direction (W). In this way, the vibration suppressor 568 is attached to the housing 66.

In this configuration, a natural vibration frequency of the housing 66 to which the vibration suppressor 568 is attached deviates from a vibration frequency transmitted to the housing 66 along with the image forming operation of the image forming apparatus 10. Accordingly, the vibration of the housing 66 is reduced.

[Operation of Exposure Apparatuses 42 and 542]

Next, operation of the exposure apparatuses 42 and 542 will be described.

When the image forming operation of the image forming apparatus 10 shown in FIG. 8 is started, and a surface of the image holder 36 is charged, the exposure apparatuses 42 and 542 cause the light emitting element 72 to emit light to irradiate the surface of the image holder 36 with exposure light (see FIG. 6A).

Here, vibration of a driving member in the apparatus main body 10*a* caused by the image forming operation is transmitted to the housing 66 of the exposure apparatus 42. As described above, both end portions of the housing 66 in the apparatus length direction (D) are supported by the springs 78 and the reference frames 130. As shown in FIG. 6A, the lens array 62 has a rectangular shape extending in the apparatus vertical direction (H) in a cross section orthogonal to the apparatus length direction (D), and the housing 66 has the pair of wall portions 66*a* extending in the apparatus vertical direction (H). Therefore, bending rigidity of the housing 66 in the vertical direction (D) is higher than bending rigidity of the housing 66 in the apparatus width direction (W), to which the lens array 62 is attached. Accordingly, the housing 66 is easy to vibrate in the apparatus width direction (W), to which the lens array 62 is attached (see an arrow F in FIG. 1).

Therefore, when resonance occurs between the natural vibration of the housing 66 and the vibration transmitted to the housing 66 along with the image forming operation, the housing 66 vibrates significantly.

In the exposure apparatus 542, a vibration suppressor 568 is attached to the housing 66. Therefore, as described above, the natural vibration frequency of the housing 66 with the vibration suppressor 568 attached deviates from the vibration frequency transmitted to the housing 66 along with the image forming operation. Accordingly, vibration of the housing 66 of the exposure apparatus 542 is reduced.

However, in the exposure apparatus 542, the vibration suppressor 568 is separated from the bottom plate 76 of the support member 70 in the vertical direction. Therefore, the housing 66 of the exposure apparatus 542 may bend in the gravity direction due to gravity acting on the vibration suppressor 568. In other words, the housing 66 of the exposure apparatus 542 may bend in the exposure direction (gravity direction). Specifically, the housing 66 bends in the vertical direction (exposure direction) such that the intermediate portion of the housing 66 shifts downward with respect to the both end portions in the apparatus length direction (D). In this way, the bending of the housing 66 in the exposure direction increases an error of imaging in which light emitted from the light emitting element 72 and transmitted through the rod lens 82 is imaged on the image holder 36. Therefore, a quality of an electrostatic latent image formed by exposure of the exposure apparatus 542 on the image holder 36 decreases.

In contrast, in the exposure apparatus 42, the vibration suppressor 68 is attached to the housing 66. Therefore, as described above, when vibration in the apparatus width direction is transmitted to the housing 66 along with image forming operation of the image forming apparatus 10, as shown in FIGS. 7A, 7B, and 7C, the weight 102 vibrates in the apparatus width direction while the elastic portion 104 of the vibration suppressor 68 is deformed. Accordingly, vibration of the housing 66 of the exposure apparatus 42 is reduced.

Here, the vibration suppressor 68 is supported by the support member 70 in the vertical direction (gravity direction). Therefore, bending of the housing 66 in the exposure direction (gravity direction) due to the gravity acting on the vibration suppressor 68 is reduced.

CONCLUSION

As described above, in the configuration including a member that reduces vibration of the housing 66, bending of the housing 66 in the gravity direction (exposure direction) in the exposure apparatus 42 is reduced compared with the exposure apparatus 542.

In the exposure apparatus 42, the vibration suppressor 68 is attached to the housing 66 since the pair of sheet springs 124 sandwich the housing 66. In other words, by adjusting the position of the housing 66 sandwiched by the pair of sheet springs 124, relative variation between the housing 66 and the vibration suppressor 68 is absorbed. Therefore, relative positional variation between the vibration suppressor 68 and the housing 66 in the gravity direction is absorbed such that a relative positional relationship between the vibration suppressor and the housing does not change compared with the case where the vibration suppressor is attached to the housing.

In the exposure apparatus 42, the pair of sheet springs 124 formed on the holding portion 120 sandwich the housing 66 in the apparatus width direction, so that the vibration suppressor 68 is attached to the housing 66. The attachment section 108 is movable with respect to the support member 70 in the apparatus width direction (W) in a predetermined range. Therefore, deviation between the center of gravity of the vibration suppressor 68 and the center of gravity of the housing 66 in the apparatus width direction is prevented compared with the case where the vibration suppressor is attached to the housing such that a relative positional relationship between the vibration suppressor and the housing does not change.

In the exposure apparatus 42, the weight 102 extends in the apparatus length direction, and the attachment section 108 extends in the apparatus length direction and sandwiches the pair of elastic portions 104 and the weight 102 in the apparatus length direction. The lower end edges 110*a* of the pair of clamping plates 110 formed on both end sides of the attachment section 108 contact the upper surface 76*b* formed on the bottom plate 76 of the support member 70 from above in the gravity direction, so that the vibration suppressor 68 is supported by the support member 70. Accordingly, posture of the vibration suppressor 68 is stabilized compared with a case where the attachment section is in contact with the support member in the gravity direction only at an intermediate portion of the attachment section in the device length direction.

In the exposure apparatus 42, a lower surface 118*a* formed on a back side portion of the attachment section 108 in the apparatus length direction and an upper surface 76*b* formed on the bottom plate 76 of the support member 70 are in face contact. Therefore, compared with a case where both end portions of the attachment section in the apparatus length direction are in point contact with the upper surface of the bottom plate, the posture of the vibration suppressor 68 is stabilized.

The image forming apparatus 10 includes the exposure apparatus 42. Therefore, as compared with the case where the exposure apparatus 542 is included, quality degradation of the electrostatic latent image formed on the image holder 36 is prevented, and quality degradation of an output image is prevented.

While the present invention has been described in detail with respect to specific exemplary embodiments, it will be apparent to those skilled in the art that various other embodiments may be used within the scope of the present invention. For example, in the above exemplary embodiment, the exposure apparatus 42 includes the vibration suppressor 68 which is a dynamic vibration absorber to reduce vibration occurring in the housing 66, but exposure apparatus 42 may include the mass damper to reduce the vibration occurring in the housing.

In the above exemplary embodiment, the lower surface 118*a* of the attachment section 108 formed on the back side portion (right side in FIG. 4) in the apparatus length direction (D) is configured to contact with the upper surface 76*b* of the bottom plate 76 of the support member 70, but portions on both end sides of the attachment section 108 in the apparatus length direction (D) may have surfaces configured to contact with the upper surface 76*b* of the bottom plate 76. In this case, compared with a case where only one end side portion in the apparatus length direction (D) is configured to contact with the upper surface 76*b* of the bottom plate 76, the attitude of the vibration suppressor is stabilized.

In the above exemplary embodiments, in the vibration suppressor 68, the pair of sheet springs 124 of the holding portion 120 sandwich the housing 66 in the apparatus width direction (W), so that the vibration suppressor 68 is attached to the housing 66. The vibration suppressor 68 may be attached to the housing 66 using a fixing material or the like. The vibration suppressor 68 may be supported by the support member 70.

In the above exemplary embodiments, the support member 70 may be formed integrally, or the support member 70 may be divided into a portion that supports the housing 66 and a portion that supports the vibration suppressor 68.

In the above exemplary embodiments, the vibration suppressor 68 may be supported by the support member 70 from below, or the vibration suppressor 68 may be supported from above by a hanging string or the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An exposure apparatus comprising:

a substrate that extends in a longitudinal direction intersecting with a gravity direction and has a plurality of light emitting elements emitting light toward a gravity direction;

a housing that extends in the longitudinal direction, to which the substrate is attached, a support section that supports both end side portions of the housing in the longitudinal direction against gravity; and a structure section having a weight that is attached to an intermediate portion of the housing in the longitudinal direction and supported by the support section in the gravity direction.

2. The exposure apparatus according to claim 1, wherein the structure section is attached to the housing and a position of the structure section is configured to be adjusted in the gravity direction with respect to the housing.

3. The exposure apparatus according to claim 2, wherein the structure section further comprises:

an attachment section to which the weight is attached; and a pair of sheet springs that are provided on the attachment section and sandwich the housing in the longitudinal direction.

4. The exposure apparatus according to claim 3, wherein the weight extends in the longitudinal direction, and the structure section further comprises:

an attachment section that extends in the longitudinal direction and sandwiches the weight in the longitudinal direction, to which the weight is attached, and in contact with the support section in the gravity direction at both end portions in the longitudinal direction.

5. The exposure apparatus according to claim 4, wherein a lower surface facing downward in the gravity direction is formed on one end portion of the attachment section in the longitudinal direction, and an upper surface that faces upward in the gravity direction and in face contact with the lower surface is formed on the support section.

6. An image forming apparatus comprising:

an image holder;

the exposure apparatus according to claim 5 that exposes the image holder to form an electrostatic latent image; and a development device that develops an electrostatic latent image of the image holder formed by the exposure apparatus.

7. An image forming apparatus comprising:

an image holder;

the exposure apparatus according to claim 4 that exposes the image holder to form an electrostatic latent image; and a development device that develops an electrostatic latent image of the image holder formed by the exposure apparatus.

8. An image forming apparatus comprising:

an image holder;

the exposure apparatus according to claim 3 that exposes the image holder to form an electrostatic latent image; and a development device that develops an electrostatic latent image of the image holder formed by the exposure apparatus.

9. The exposure apparatus according to claim 2, wherein the weight extends in the longitudinal direction, and the structure section further comprises:

an attachment section that extends in the longitudinal direction and sandwiches the weight in the longitudinal direction, to which the weight is attached, and in contact with the support section in the gravity direction at both end portions in the longitudinal direction.

10. The exposure apparatus according to claim 9, wherein a lower surface facing downward in the gravity direction is formed on one end portion of the attachment section in the longitudinal direction, and an upper surface that faces upward in the gravity direction and in face contact with the lower surface is formed on the support section.

11. An image forming apparatus comprising:

an image holder;

the exposure apparatus according to claim 10 that exposes the image holder to form an electrostatic latent image; and a development device that develops an electrostatic latent image of the image holder formed by the exposure apparatus.

12. An image forming apparatus comprising:

an image holder;

the exposure apparatus according to claim 9 that exposes the image holder to form an electrostatic latent image; and a development device that develops an electrostatic latent image of the image holder formed by the exposure apparatus.

13. An image forming apparatus comprising:

an image holder;

the exposure apparatus according to claim 2 that exposes the image holder to form an electrostatic latent image; and a development device that develops an electrostatic latent image of the image holder formed by the exposure apparatus.

14. The exposure apparatus according to claim 1, wherein the weight extends in the longitudinal direction, and the structure section further comprises:

an attachment section that extends in the longitudinal direction and sandwiches the weight in the longitudinal direction, to which the weight is attached, and in contact with the support section in the gravity direction at both end portions in the longitudinal direction.

15. The exposure apparatus according to claim 14, wherein a lower surface facing downward in the gravity direction is formed on one end portion of the attachment section in the longitudinal direction, and an upper surface that faces upward in the gravity direction and in face contact with the lower surface is formed on the support section.

16. An image forming apparatus comprising:

an image holder;

the exposure apparatus according to claim 15 that exposes the image holder to form an electrostatic latent image; and a development device that develops an electrostatic latent image of the image holder formed by the exposure apparatus.

17. An image forming apparatus comprising:

an image holder;

the exposure apparatus according to claim 14 that exposes the image holder to form an electrostatic latent image; and a development device that develops an electrostatic latent image of the image holder formed by the exposure apparatus.

18. An image forming apparatus comprising:

an image holder;

the exposure apparatus according to claim 1 that exposes the image holder to form an electrostatic latent image; and a development device that develops an electrostatic latent image of the image holder formed by the exposure apparatus.

* * * * *